US007412736B2

(12) United States Patent
Hyre et al.

(10) Patent No.: US 7,412,736 B2
(45) Date of Patent: Aug. 19, 2008

(54) CONJOINED ELECTRICAL CORDS FOR AN EXAMINATION TABLE

(75) Inventors: Rodney L. Hyre, Versailles, OH (US); Randall H. Evers, Osgood, OH (US)

(73) Assignee: Midmark Corporation, Versailles, OH (US)

( * ) Notice: Subject to any disclaimer, the term of this patent is extended or adjusted under 35 U.S.C. 154(b) by 466 days.

(21) Appl. No.: 11/225,272

(22) Filed: Sep. 13, 2005

(65) Prior Publication Data

US 2007/0056105 A1 Mar. 15, 2007

(51) Int. Cl.

| | |
|---|---|
| ***A61G 7/002*** | (2006.01) |
| ***A61G 7/05*** | (2006.01) |
| ***A61G 13/02*** | (2006.01) |
| ***A61G 13/10*** | (2006.01) |

(52) U.S. Cl. ..... 5/613; 5/618; 5/600; 5/424

(58) Field of Classification Search ..... 5/600, 5/613–619, 607–611, 424

See application file for complete search history.

(56) References Cited

U.S. PATENT DOCUMENTS

| | | | | | |
|---|---|---|---|---|---|
| 3,781,927 | A | * | 1/1974 | Zakaras | 5/616 |
| 3,917,979 | A | * | 11/1975 | Volk, Jr. | 361/50 |
| 3,961,319 | A | * | 6/1976 | Asberry | 340/649 |
| 3,996,496 | A | | 12/1976 | Volk, Jr. | 317/18 B |
| 4,083,041 | A | | 4/1978 | Bennice | 340/255 |
| 5,390,382 | A | * | 2/1995 | Hannant et al. | 5/424 |
| 5,398,149 | A | | 3/1995 | Weil | 361/50 |

* cited by examiner

*Primary Examiner*—Alexander Grosz
(74) *Attorney, Agent, or Firm*—Wood, Herron & Evans LLP

(57) ABSTRACT

An examination table including an actuatable patient surface comprising electronic components configured to adjust said examination table, a power supply to provide power to said electronic components and an electric power receptacle mounted to said examination table. A first electrical power cord is configured to connect said power supply to a first power source and a second electrical power cord is configured to connect said electric power receptacle to a second power source, wherein the electric power receptacle is grounded through said second electrical power cord. A conjoining connector is configured to attach the first electrical power cord to the second electrical power cord along the length of the cords.

12 Claims, 2 Drawing Sheets

CONJOINED ELECTRICAL CORDS FOR AN EXAMINATION TABLE

FIELD OF THE INVENTION

The present invention generally relates to examination tables and, more particularly, to shielding a patient occupying an examination table from leakage current.

BACKGROUND OF THE INVENTION

Medical examination tables are conventionally provided with various electrical components. One such common component includes one or more electrical outlets for plugging in accessories. Despite their convenience and utility, outlets on tables may be a source of leakage current. Leakage current is the current that can flow through a protective ground conductor to ground. In the absence of a grounding connection, leakage current could seek ground through a path that includes a patient's body.

This undesirable phenomenon is addressed conventionally by including an isolation transformer on the power supply to an accessory receptacle. The ground from the accessory receptacle is typically tied to the chassis of the table. Arranged as such, leakage current from the accessory seeks the transformer's secondary, and not earth ground. That is, leakage current from the accessory electrical receptacle seeks the secondary of the isolation transformer instead of an earth ground, thereby protecting patients and operators from closing the grounding circuit and receiving an electrical shock or other injury. Despite their effectiveness, however, such isolation transformers add complexity and additional manufacturing costs to tables so equipped. There is consequently a need for an improved manner of grounding leakage current.

SUMMARY OF THE INVENTION

Embodiments of the present invention address the problems of the prior art by isolating the accessory receptacle from the table chassis and running a second power cord complete with a ground from the accessory receptacle to an electrical power source. Another cord that may be grounded to the table chassis may be used to power the remaining electrical components of the examination table. The two cords may be connected together with molded loops or other conjoining connectors to keep the cords together. The conjoined cord feature is simpler and less expensive than isolation transformer approaches, while providing the necessary patient protection from leakage current.

From the foregoing disclosure and the following more detailed description of various embodiments it will be apparent to those skilled in the art that the present invention provides a cost savings in the manufacturing of examination tables with accessory receptacles. Particularly significant in this regard is the potential the invention affords for providing a method of attaching the accessory receptacle that is less expensive and less complex than using an isolation transformer. Additional features and advantages of various embodiments will be better understood in view of the detailed description provided below.

BRIEF DESCRIPTION OF THE DRAWINGS

These and further features of the present invention will be apparent with reference to the following description and drawings wherein.

It should be understood that the appended drawings are not necessarily to scale, presenting a somewhat simplified representation of various features illustrative of the basic principles of the invention. The specific design features of the conjoined cords as disclosed herein, including, for example, specific dimensions, orientations, locations, and shapes of various components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION

Figure 1:
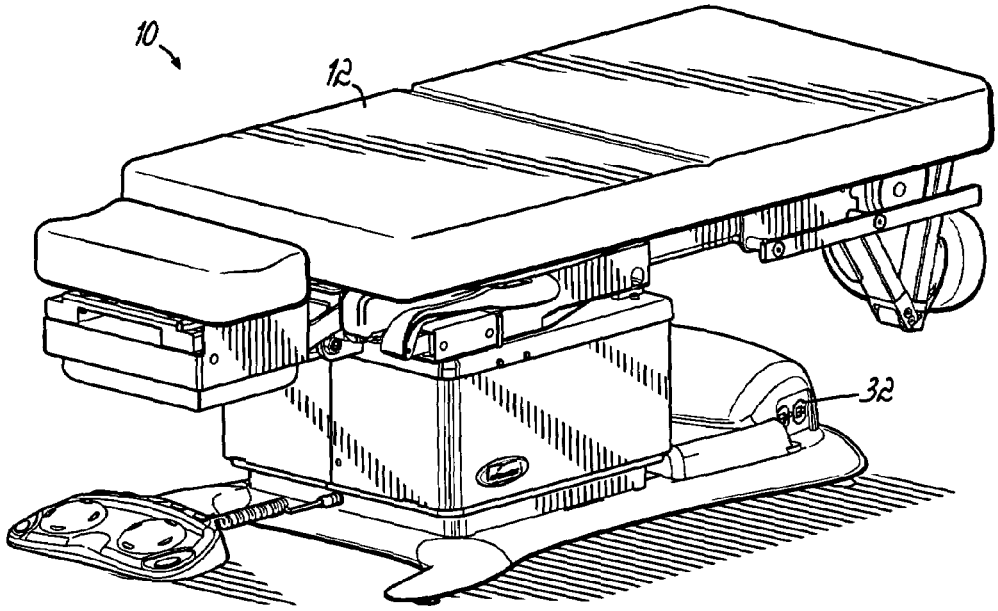
FIG. 1 is perspective view of an examination table with an actuatable patient surface suitable for using the conjoined cords consistent with the invention.
Figure 2:
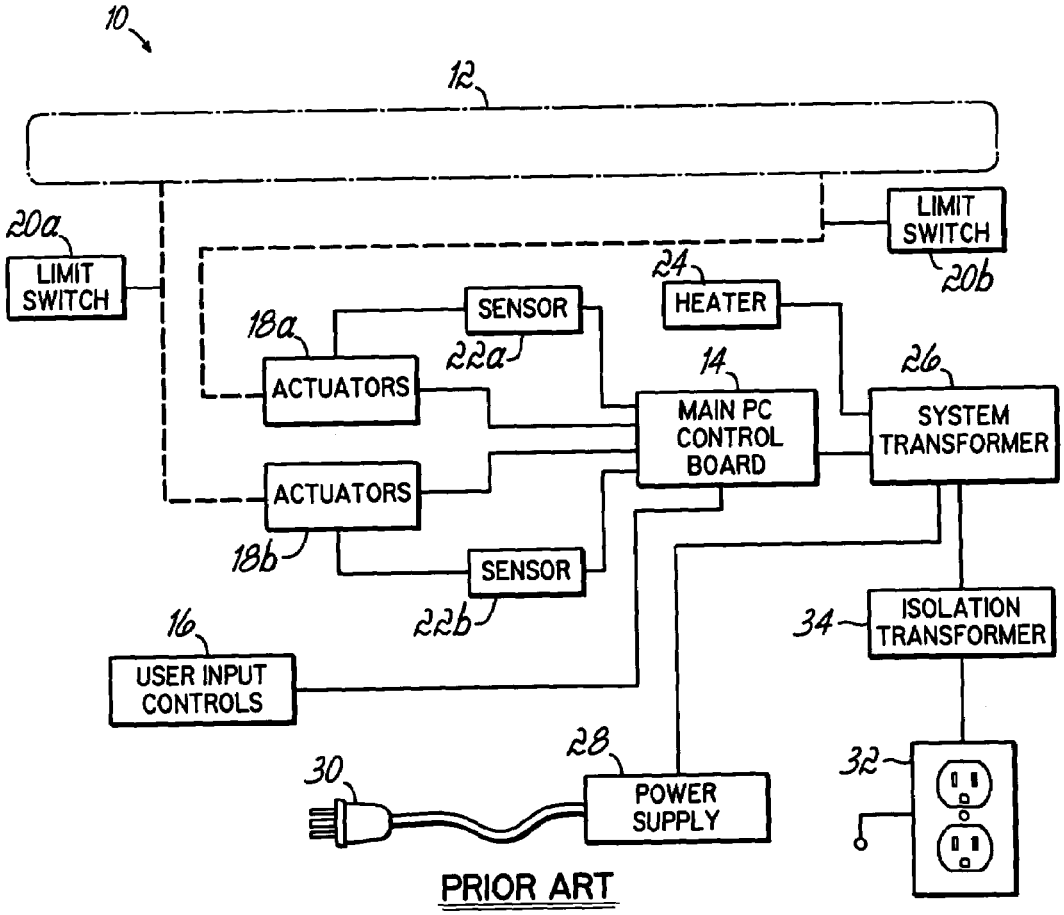
PRIOR ART FIG. 2
FIG. 2 is a block diagram of the prior art electronics associated with an examination table showing the accessory electrical receptacles attached to the examination table power supply through an isolation transformer and the electrical outlets grounded to the examination table.

FIG. 1 is perspective view of an examination table 10 with an actuatable patient surface 12. FIG. 2 shows a conventional block diagram for electrical components of an examination table 10, such as is shown in FIG. 1. To achieve the actuation of the surface, the examination table 10 contains a plurality of actuators 18*a*, 18*b* that adjust the patient surface(s). The actuators 18*a*, 18*b* are connected to a main PC control board 14 of the examination table 10. The actuators 18*a*, 18*b* are monitored by a plurality of position sensors 22*a*, 22*b*. Movements of the actuators 18*a*, 18*b* are limited by a plurality of limit switches 20*a*, 20*b*. The limit switches 20*a*, 20*b* and position sensors 22*a*, 22*b* are also connected to the main PC control board 14. The actuators 18*a*, 18*b* are controlled by user input controls 16 that are either operated by hand or by foot. The user input controls 16 are connected to the main PC control board 14. The main PC control board 14 is connected to the secondary side of a main system transformer 26. The primary side of the main system transformer 26 is connected to a power supply 28, which is in turn connected to a first electrical power cord 30. An optional heater 24 for drawers or patient surfaces may also be connected to the examination table on the primary side of the main system transformer 26.

Accessory electrical receptacles 32 are conventionally mounted to the examination table 10. The accessory electrical receptacles 32 are connected to the secondary side of an isolation transformer 34. The primary side of the isolation transformer 34 is connected to the power supply 28. The accessory electrical receptacles 32 are grounded to the chassis of the examination table 12. Leakage currents from the accessory electrical receptacles 32 seek the secondary of the isolation transformer 34 instead of an earth ground, thereby protecting patients and operators from closing the grounding circuit and receiving an electrical shock or other injury.

Figure 3:
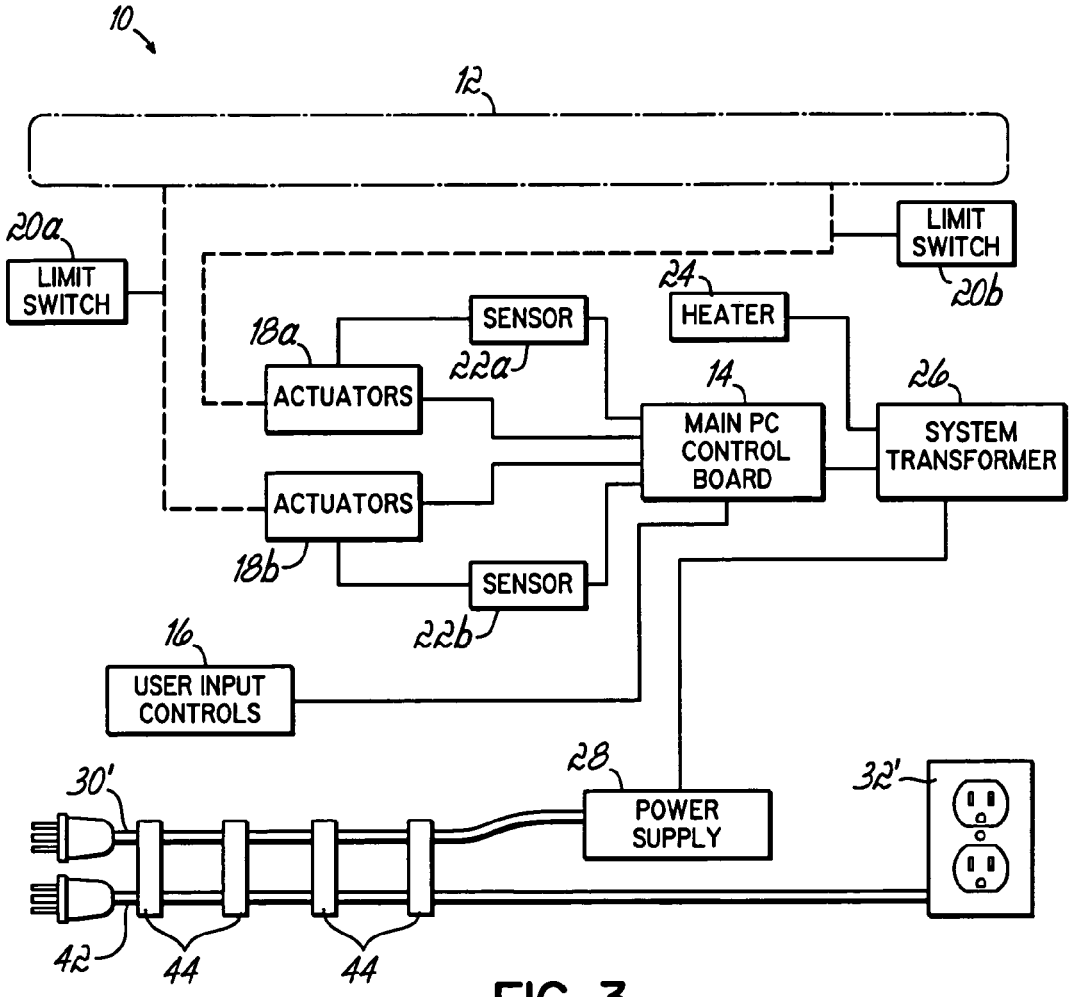
FIG. 3 is a block diagram of the electronics associated with an examination table showing the accessory electrical receptacles attached directly to an electrical power cord that can be plugged into an electric wall outlet.

FIG. 3 shows a modified block diagram consistent with embodiments of the present invention for the electrical components of an examination table 10 containing an actuatable patient surface 12. Referring now to FIG. 3, the electrical components have been modified so the isolation transformer 34 is removed from the electrical components of the examination table 10. The accessory electrical receptacles 32' are electrically isolated when they are mounted to the examination table 10. A second electrical power cord 42 is directly connected to the accessory electrical receptacles 32'. The second electrical power cord 42 contains a mechanism for grounding that is used to directly ground the accessory electrical receptacles 32' through the second electrical power cord 42. The mechanism for grounding may include a third wire and prong contained in the second electrical cord that has the purpose of providing a ground path for the leakage current.

Figure 4:
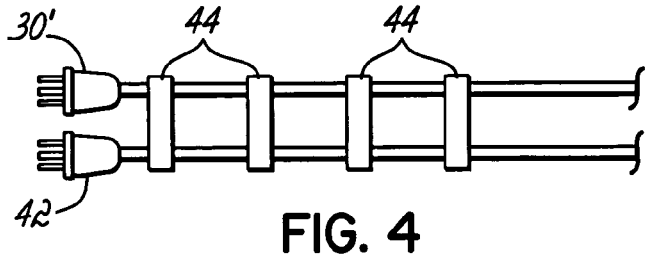
FIG. 4 shows the electrical power cords for the examination table and the accessory electrical receptacles held together with conjoining connectors.

Referring now to FIG. 4, a first electrical power cord 30' (similar to the power cord 30 of FIG. 2) and the second electrical power cord 42 are connected together along the length of the cords with molded loops referred to as conjoining connectors 44. The conjoining connectors keep both cords together to make it easier for the operator of the examination table to connect the first electrical power cord 30' and the second electrical power cord 42 to an electrical outlet (not pictured) providing the electrical power source.

From the forgoing disclosure and detailed description of certain embodiments, it will be apparent that various modifications, additions, and other alternative embodiments are possible without departing from the true scope and spirit of the present invention. For example, it will be apparent to those skilled in the art, given the benefit of the present disclosure, that the examination table may have many different components and configurations. Other electrical components of the examination table could be directly connected to power sources with the conjoined electrical power cord configuration. The embodiment that was discussed was chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An examination table including at least one actuatable patient surface comprising:

an electronic component including at least one actuator, configured to adjust said examination table;

a power supply to provide power to said electronic component;

an electric power receptacle mounted to said examination table, wherein the electric power receptacle is electrically isolated from said examination table;

a first electrical power cord comprising a plug end, configured to connect said power supply to a first power source; and a second electrical power cord comprising a plug end, configured to connect said electric power receptacle to a second power source, wherein the electric power receptacle is grounded through said second electrical power cord.

2. The examination table of claim 1 further comprising:

a conjoining connector configured to attach the first electrical power cord to the second electrical power cord.

3. The examination table of claim 2 further comprising:

an additional conjoining connector, wherein the conjoining connectors are spaced along the length of said first and second electric power cords.

4. The examination table of claim 1 wherein said electronic component comprises:

a plurality of actuators to adjust said patient surfaces, wherein said plurality of actuators are connected to a main PC control board;

a first user input control designed to be operated by a hand, wherein the first user input control is connected to said main PC control board;

a second user input control designed to be operated by a foot, wherein the second user input control is connected to said main PC control board;

a plurality of limit switches connected to said main PC control board; and a plurality of position sensors connected to said main PC control board.

5. The examination table of claim 4 further comprising:

a main system transformer having a primary and a secondary side, wherein said main PC control board connected to said secondary side of the main system transformer and wherein said power supply is connected to said primary side of the main system transformer.

6. The examination table of claim 5 further comprising:

a heater system that connected to said primary side of the main system transformer.

7. The examination table of claim 1 further comprising:

an electric wall receptacle comprising:

a first electric outlet providing said first power source; and a second electric outlet providing said second power source;

wherein said plug end of said first electrical power cord is connected to said first electric outlet providing said first power source and said plug end of said second electrical power cord is connected to said second electric outlet providing said second power source.

8. A method for connecting electric accessory receptacles to an examination table comprising at least one patient support surface adapted to be adjusted by an actuator, said method comprising:

mounting the electric power receptacle to the examination table;

connecting a first electrical power cord attached to said examination table to a first power source said power cord adapted to provide power to said actuator, and comprising a plug end;

connecting a second electrical power cord, comprising a plug end, and attached to said electric power receptacle to a second power source; and grounding said electric power receptacle through said second electrical power cord.

9. The method of claim 8 further comprising:

attaching said first electric power cord to said second electric power cord with a conjoining connector.

10. The method of claim 9 further comprising:

attaching an additional conjoining connector to said first and second electric power cords, wherein the conjoining connectors are spaced along the length of said first and second electric power cords.

11. The method of claim 9 further comprising:

connecting said plug end of said first electrical power cord to an electric wall receptacle comprising a first electric outlet providing said first power source.

12. The method of claim 11 further comprising:

connecting said plug end of said second electrical power cord to said electric wall receptacle further comprising a second electric outlet providing said second power source.

* * * * *

UNITED STATES PATENT AND TRADEMARK OFFICE

CERTIFICATE OF CORRECTION

PATENT NO. : 7,412,736 B2
APPLICATION NO. : 11/225272
DATED : August 19, 2008
INVENTOR(S) : Hyre et al.

It is certified that error appears in the above-identified patent and that said Letters Patent is hereby corrected as shown below:

Column 2
Line 1, reads "FIG. 1 is perspective view of an" and should read -- FIG. 1 is a perspective of an --.

Column 2
Line 31, reads "FIG. 1 is perspective view of" and should read -- FIG. 1 is a perspective view of --.

Column 4
Line 16, CLAIM 5, reads "wherein said main PC control board connected to said secondary side of" and should read -- wherein said main PC control board is connected to said secondary side of --.

Line 21, CLAIM 6, reads "a heater system that connected to said" and should read -- a heater system that is connected to said --.

Line 40, CLAIM 8, reads "to a first power source said power cord adapted" and should read -- to a first power source, said power cord adapted --.

Line 56, CLAIM 11, reads "The method of claim 9 further comprising" and should read -- The method of claim 8 further comprising --.

Signed and Sealed this

Seventeenth Day of February, 2009

JOHN DOLL
*Acting Director of the United States Patent and Trademark Office*